US009556545B2

(12) United States Patent
Mather et al.

(10) Patent No.: US 9,556,545 B2
(45) Date of Patent: Jan. 31, 2017

(54) WATER-TRIGGERED ORIGAMI WITH A POLYMERIC WEB

(71) Applicants: Patrick T. Mather, Oxford, PA (US); Jaimee Marie Robertson, Cortland, NY (US); Amir Torbati, Denver, CO (US)

(72) Inventors: Patrick T. Mather, Oxford, PA (US); Jaimee Marie Robertson, Cortland, NY (US); Amir Torbati, Denver, CO (US)

(73) Assignee: Syracuse University, Syracuse, NY (US)

( * ) Notice: Subject to any disclaimer, the term of this patent is extended or adjusted under 35 U.S.C. 154(b) by 0 days.

(21) Appl. No.: 14/666,795

(22) Filed: Mar. 24, 2015

(65) Prior Publication Data

US 2015/0267328 A1 Sep. 24, 2015

Related U.S. Application Data

(60) Provisional application No. 61/969,505, filed on Mar. 24, 2014.

(51) Int. Cl.

| | |
|---|---|
| ***D04H 1/72*** | (2012.01) |
| ***D04H 1/42*** | (2012.01) |
| ***D04H 1/728*** | (2012.01) |
| ***D04H 1/4282*** | (2012.01) |

(52) U.S. Cl.

CPC ..... *D04H 1/728* (2013.01); *D04H 1/4282* (2013.01); *D10B 2321/08* (2013.01)

(58) Field of Classification Search

CPC ..... D04H 1/728; D04H 1/4284; B65H 45/00; B65H 2301/12; D10B 2321/08

USPC ..... 526/330

See application file for complete search history.

(56) References Cited

U.S. PATENT DOCUMENTS 4,517,240 A * 5/1985 Tracton ..... D21H 19/32 156/62.2

OTHER PUBLICATIONS over Panthi et al. "Polyaniline-Poly(vinyl acetate) Electrospun Nanofiber Mats as Novel Organic Semiconductor Material", Science of Advanced Materials, vol. 4, pp. 1-9, 2012.*

Panthi et al. "Polyaniline-Poly(vinyl acetate) Electrospun Nanofiber Mats as Novel Organic Semiconductor Material", Science of Advanced Materials, vol. 4, pp. 1-9, 2012.*

* cited by examiner

*Primary Examiner* — Michael M Bernshteyn

(74) *Attorney, Agent, or Firm* — David L. Nocilly; Bond, Schoeneck & King, PLLC

(57) ABSTRACT

A hydrophobic polymer fiber mat that folds in response to the application of water along a predetermined fold line, thereby allowing for the formation of three-dimensional objects strictly through the targeted application of water. The fiber mat is preferably formed by electrospinning a polymer, such as poly(vinyl acetate), to form mats with average fiber diameters ranging from 0.5 to 1 μm.

5 Claims, 7 Drawing Sheets

DSC – dry and hydrated

WATER-TRIGGERED ORIGAMI WITH A POLYMERIC WEB

BACKGROUND OF THE INVENTION

1. Field of the Invention

The present invention relates to shape memory polymers and, more specifically, to a self-folding polymer web.

2. Description of the Related Art

Advances in technology aim to reduce the degree of manual labor in construction and use. Devices that self-assemble are of particular interest for various applications. Origami is among the usable techniques to fabricate self-folding or self-assembling three-dimensional (3D) structures for applications in the aerospace and biomedical fields. As an example, aerospace structures require effective deployment of self-assembled space structures. Another example of using self-folding structures is the field of drug delivery where such structures may be used for delivering therapeutic drugs to targeted areas.

One focus of current research is the development of programmable self-assembling structures. For this, computer programming is required, and the program signals are sent into the material, detailing the steps of construction. An advantage of this approach is that after construction, additional programs can be sent to the structure, allowing it to reassemble into another shape. Another approach to self-assembling structures utilizes 4-dimensional (4D) printing, where the fourth dimension is time. In this case, the printed material, or one of the printed materials, responds to an environmental stimulus, resulting in a conformational change of the printed object. Drawbacks to this approach include the current size and material limitations of 3D printing and the need for a preconceived ending state; the final shape of the object must be determined prior to printing, and the shape changing mechanism must be planned to determine the geometry of the printed object.

BRIEF SUMMARY OF THE INVENTION

The present invention comprises a new design strategy for foldable products made of polymers using origami techniques. According to the present invention, new foldable designs or geometries will be possible. With origami as a source of inspiration, the present invention involves a water-triggered origami system that enables assembly of structures with minimal handling that uses electrospun poly(vinyl acetate) (PVAc) fiber mats that fold when stripes of water are drawn on the mat. As water permeates through the mat and is absorbed by the PVAc, a gradient of shrinkage forms through the thickness of the mat, causing folding. This shrinkage is mainly caused by the decrease in the glass transition temperature of PVAc fiber mat upon hydration, allowing spatially localized relaxation of processing-induced molecular orientation and associated local fiber shrinkage. The combination of strategic sample cutting and water line placement allow for the self-assembly of more intricate structures.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
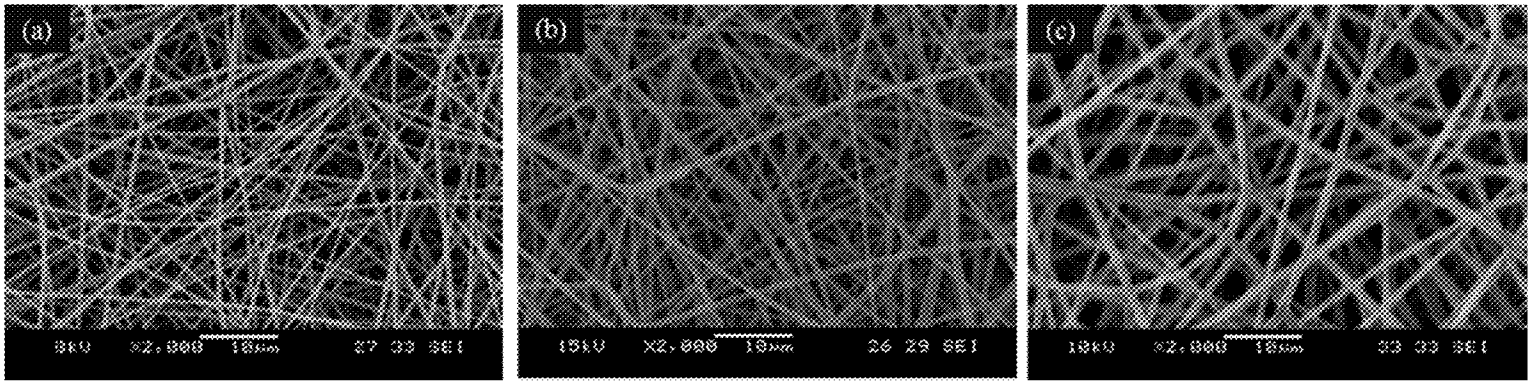
FIG. 1 is a series of scanning electron microscope (SEM) images of three different polymer fiber mats according to the present invention having average fiber diameters ranging from 0.5 to 1 μm.
Figure 2:
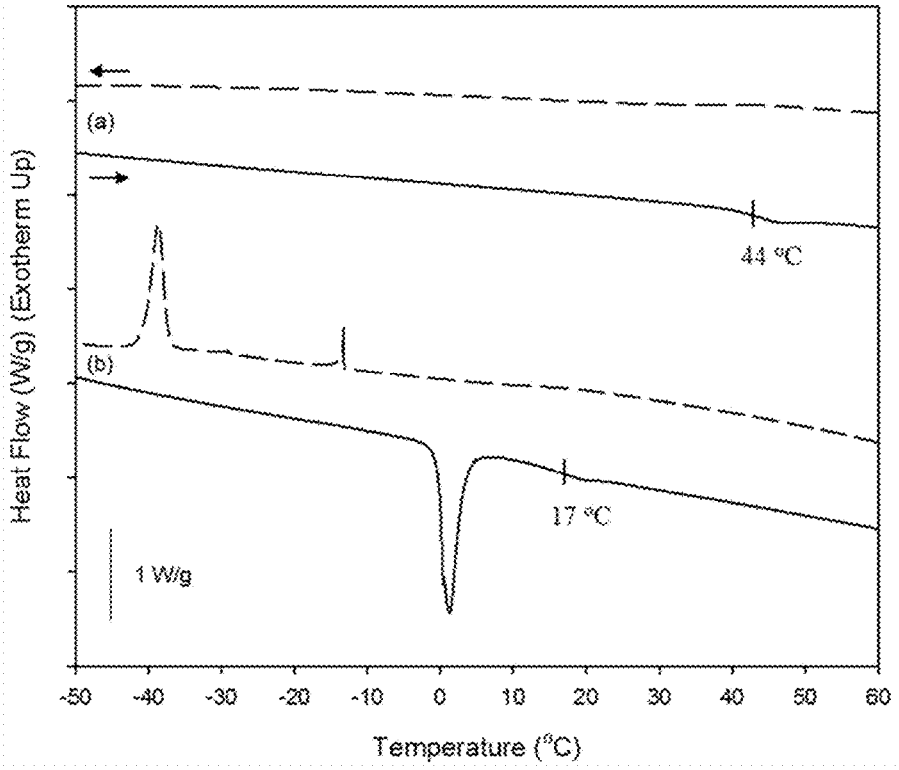
FIG. 2 is a graph of the representative DSC traces of (a) dry and (b) hydrated PVAc fiber mats used to determine the glass transition temperatures. The second heating and cooling are shown in solid and dashed lines, respectively.

Referring now to the drawings, wherein like reference numerals refer to like parts throughout, there is seen in FIG. 1 a series of micrographs of a polymer fiber mat 10 that may be used to provide a water-triggered, self-folding structure according to the present invention. When water is applied to polymer fiber mat 10, the water molecules plasticize the polymer in mat 10, thereby significantly reducing the glass transition temperature. If the glass transition temperature is reduced to a temperature near that of the environment, the hydrated mat 10 will shrink as the molecular chains tend towards a lower energy state. FIG. 2 shows such a reduction in glass transition temperature. This shrinkage, along with the slow permeation of water through the thickness of hydrophobic polymer fiber mat 10, is exploited to provide self-assembling 3D structures.

EXAMPLE

Figure 3:
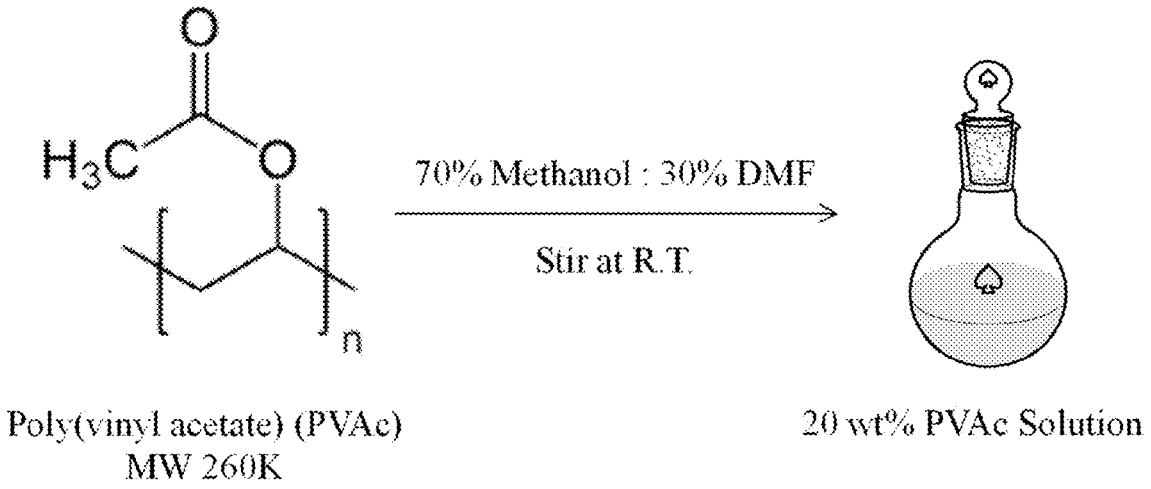
FIG. 3 is a schematic of the preparation of a polymer solution used for electrospinning PVAc fiber mats according to the present invention.

Poly(vinyl acetate) (PVAc) (weight average molecular weight MW=260,000 g/mol) was chosen as the polymer for this example of the present invention. PVAc was dissolved in a solution containing 70% methanol and 30% N,N-dimethylformamide (DMF) by volume, as seen in FIG. 3, to obtain a 20 wt % polymer solution to be used for electrospinning Electrospinning parameters, including the flow rate of the polymer solution, the voltage applied to the syringe needle, and the electrospinning time, were varied to obtain mats with varying fiber diameters and thicknesses. Electrospinning is a technique that is commonly used to extract fibers from a polymer solution and involves a polymer solution is contained in a syringe with a metal needle. The metal needle is charged to 6-14 kV using a high voltage power supply. The polymer solution within the syringe becomes charged, and a cone forms at the tip of the syringe needle due to electrostatic repulsion. At a critical point, a charged jet of the polymer solution forms and is shot towards the grounded drum, which rotates at 400 rpm.

Before reaching the drum, the solvent in the polymer solution evaporates, and fibers collect on the drum. The syringe pump ensures a constant flow of polymer solution and allows for the fabrication of a web with long, continuous nanofibers. The exact size of the fibers is affected by the flow rate of the polymer solution as well as the electrospinning voltage and the concentration of the solution.

Due to the voltage applied to the polymer solution and the ensuing elongational flow that stretches the jet on transit to the collecting drum, the polymer chains become oriented along the length of the electrospun fibers and the polymer is in a high-energy state. Raising the temperature of the fiber mat above the characteristic glass (for PVAc) or melting (for semicrystalline polymers) transition temperature of the polymer allows the chains to reconfigure to a relaxed, lower energy state. The result is a significant reduction in size of the fiber mat.

As seen in FIG. 1 scanning electron microscopy (SEM) was used to visualize the polymer fibers in the electrospun mats and includes views of three different mats with average fiber diameters ranging from 0.5 to 1 μm. Referring to FIG. 2, representative DSC traces of an electrospun PVAc fiber mat are seen in both the dry and hydrated state. The measured glass transition temperatures of the dry and hydrated PVAc fiber mats were 44° C. and 17° C., respectively. The plasticization of the PVAc in water reduces the glass transition temperature by 27° C. to below room temperature. A fiber mat submerged in water experiences a significant reduction in size as the polymer chains relax and tend towards a lower energy state. The shrinkage of the mat is a relatively slow process, as PVAc is hydrophobic and resists water absorption. The hydrophobicity and shrinkage of the PVAc in water are used for water-triggered origami according to the present invention.

Figures 4A, 4B:
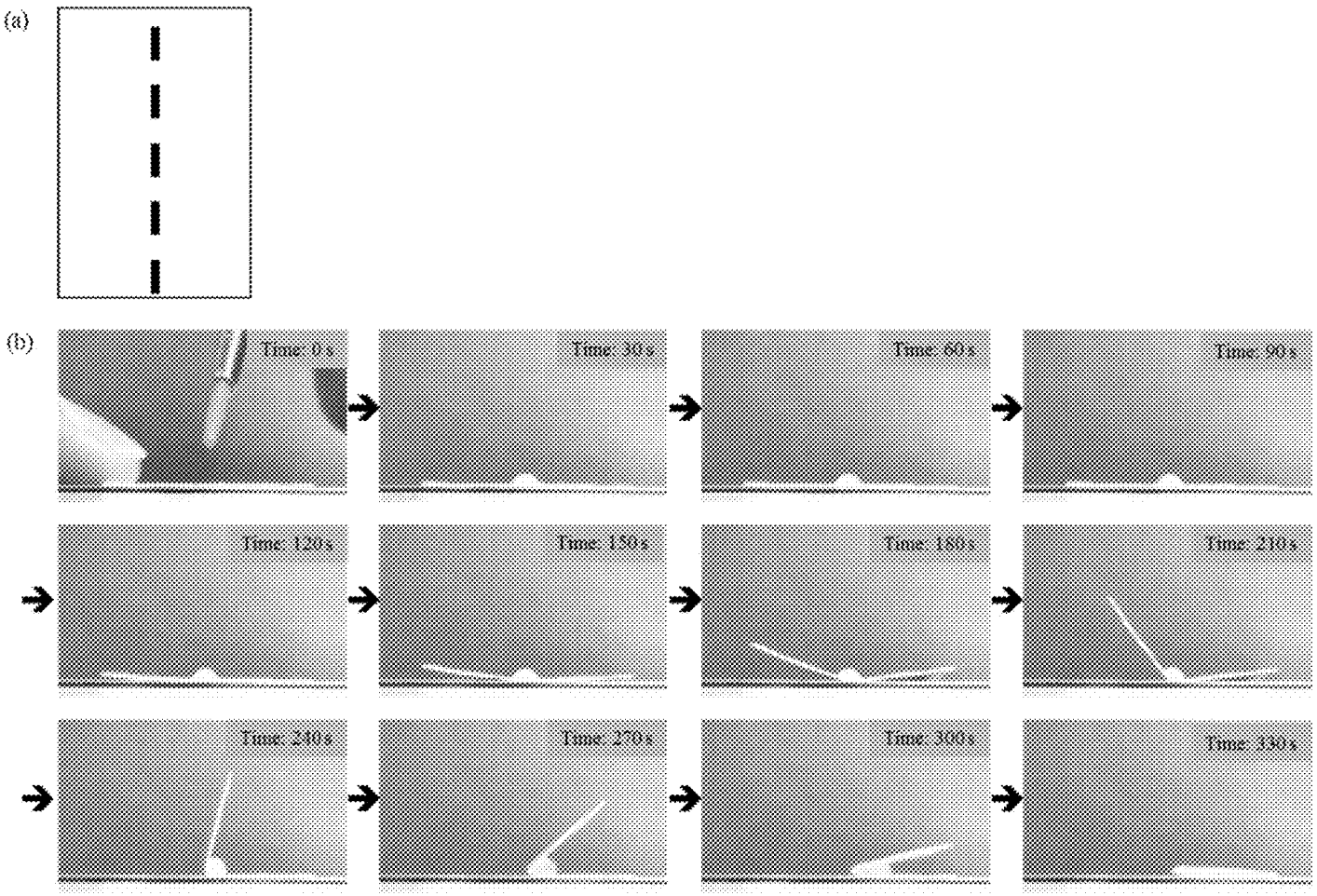
FIG. 4A is a schematic of a predetermined folding line according to the present invention, with FIG. 4B including a series of images showing the folding of a polymer mat according to FIG. 4A over time.

A line of water drawn on a PVAc fiber mat according to the present invention maintains its shape and does not spread or widen significantly because of the hydrophobicity of the PVAc. As the water slowly permeates through the thickness of the mat and diffuses through the fibers, a gradient of shrinkage forms through the mat thickness. This shrinkage gradient causes the mat to fold. FIG. 4B shows side-view images of a rectangular fiber mat 30×18 mm in dimension folding over time. As shown in FIG. 4A, a stripe of water was drawn on the surface of the mat in order to achieve a completely folded mat. The time needed for the mat to fold can be tuned by varying the average fiber diameter and the thickness of the mat. Smaller fiber diameters and thicker mats result in more prolonged folding.

Figures 5A, 5B:
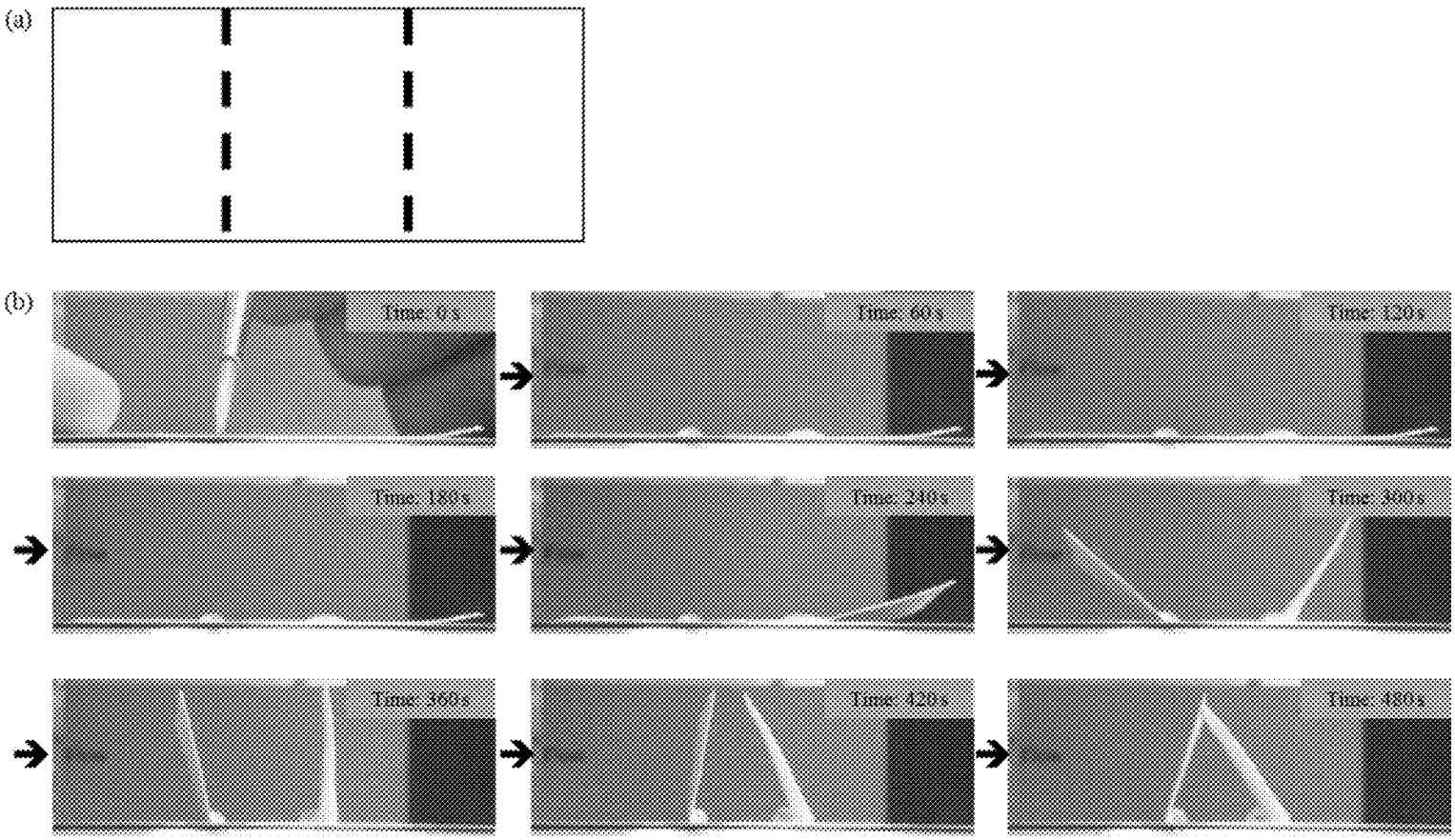
FIG. 5A is a schematic of a series of predetermined folding lines according to the present invention, with FIG. 5B including a series of images showing the folding of a polymer mat according to FIG. 5A over time.
Figures 6A, 6B:
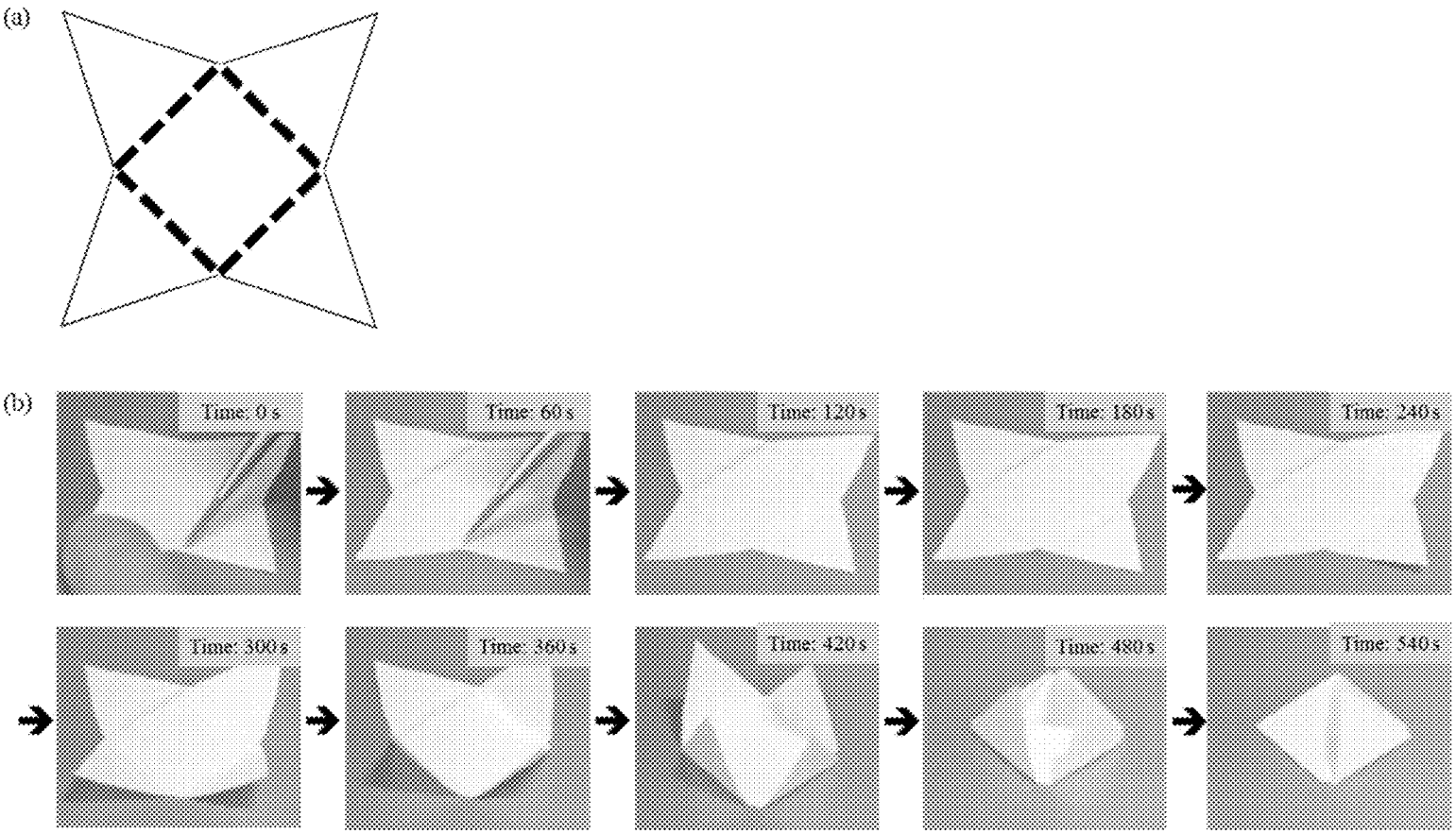
FIG. 6A is a schematic of a series of predetermined folding lines to form a pyramid according to the present invention, with FIG. 6B including a series of images showing the folding of a polymer mat according to FIG. 6A over time.

More complex three-dimensional structures can be constructed by strategically drawing lines of water on the mat and forcing the mat to hit itself before completely folding. Two such structures are a triangle and a pyramid. A triangle can be constructed by drawing two equally spaced parallel lines on a rectangular mat as seen in FIG. 5A. Side-view images of the triangle forming over time are seen in FIG. 5B. To construct the pyramid, a four-pronged star is cut from an electrospun fiber mat and stripes of water are drawn at the base of each prong, as seen in FIG. 6A. As the prongs rise together, they hit at the top, forming a pyramid, as shown in the images in FIG. 6B.

Figure 7:
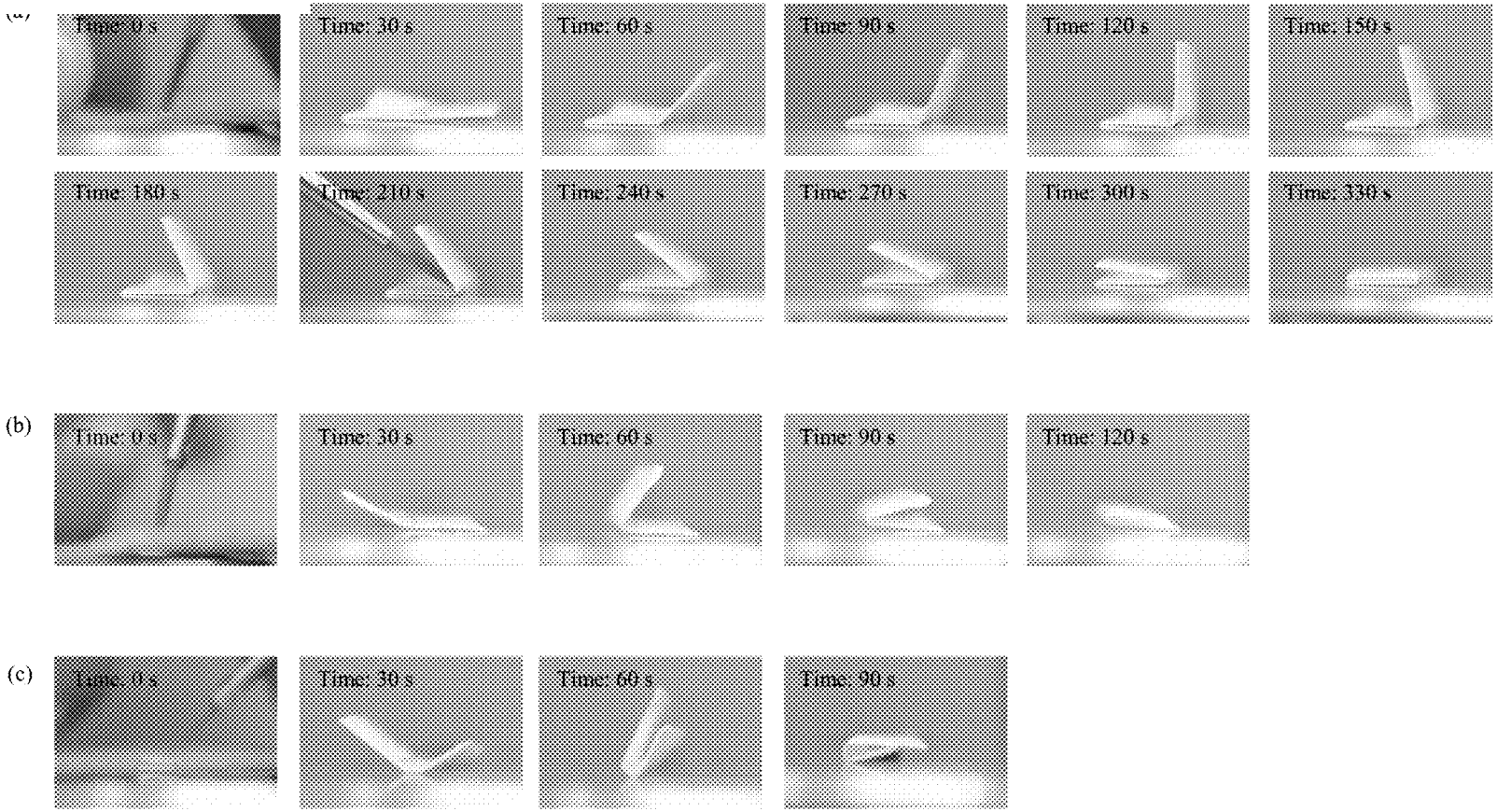
FIG. 7 is a series of images of folding rates under different circumstances.

Referring to FIG. 7, the rate of folding can a further be controlled by varying the width of the water line applied to the fiber mat. Wider water lines amplify the shrinkage gradient and accelerate the folding. However, the faster folding rate is also accompanied by a decrease in sharpness of the fold angle. Wide lines tend to result in more of a bending of the fiber mat due to the wider area involved. Side-view images of fiber mats folding over time are seen in FIG. 7, which illustrates the effects of water line thickness on folding rate and geometry. In FIG. 7, water lines (a) 1, (b) 3, and (c) 5 mm wide were drawn on rectangular fiber mats. The folding speed is accelerated with wider lines and wider water lines result in a larger bending curvature.

Various three-dimensional objects can be constructed by strategically placing water lines on fiber mats that have been previously cut in predetermined shapes to achieve the desired three-dimensional object. Drawing the lines of water at the appropriate time relative to other lines of water may be necessary to ensure proper collision of the mat. The present invention may thus be used for craft projects, but are also useful in the medical and aerospace fields.

What is claimed is:

1. A water triggering folding system, comprising:

a hydrophobic polymer fiber mat having a glass transition temperature about 44°C. when dry and about 17°C. when hydrated, wherein the fiber mat comprises poly (vinyl acetate) having a weight average molecular weight of about 260,000 g/mol.

2. The system of claim 1, wherein the fiber mat has an average fiber diameter of between 0.5 to 1 μm.

3. A method of folding a planar sheet into a three-dimensional shape, comprising the steps of:

providing the hydrophobic polymer fiber mat of claim 1;

applying water along at least one region of the fiber mat; and allowing the water to hydrate the at least one region of the fiber mat until the glass transition temperature of the at least one region decreases to below room temperature.

4. The method of claim 3, wherein the fiber mat has an average fiber diameter of between 0.5 to 1 μm.

5. The method of claim 3, further comprising the step of allowing the fiber mat to fold along the at least one region until the fiber mat forms a three-dimensional shape.

* * * * *